US007040954B1

(12) United States Patent
McClatchie et al.

(10) Patent No.: US 7,040,954 B1
(45) Date of Patent: May 9, 2006

(54) METHODS OF AND APPARATUS FOR CONTROLLING POLISHING SURFACE CHARACTERISTICS FOR CHEMICAL MECHANICAL POLISHING

(75) Inventors: Simon McClatchie, Fremont, CA (US); Peter Norton, Emeryville, CA (US); Xuyen Pham, Fremont, CA (US); Ren Zhou, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/952,608

(22) Filed: Sep. 28, 2004

(51) Int. Cl.
*B24B 49/18* (2006.01)
*B24B 53/00* (2006.01)

(52) U.S. Cl. ..... 451/5; 451/56

(58) Field of Classification Search ..... 451/5, 451/41, 443, 444, 72, 21, 56
See application file for complete search history.

(56) References Cited

U.S. PATENT DOCUMENTS

| | | | | |
|---|---|---|---|---|
| 5,036,015 | A | 7/1991 | Sandhu et al. | 438/14 |
| 5,069,002 | A * | 12/1991 | Sandhu et al. | 451/1 |
| 5,216,843 | A | 6/1993 | Breivogel et al. | 51/131.1 |
| 5,308,438 | A * | 5/1994 | Cote et al. | 216/86 |
| 5,904,608 | A | 5/1999 | Watanabe | 451/5 |
| 5,941,762 | A | 8/1999 | Ravkin et al. | 451/56 |
| 6,036,583 | A | 3/2000 | Perlov et al. | 451/56 |
| 6,042,457 | A | 3/2000 | Wilson et al. | 451/56 |
| 6,093,080 | A * | 7/2000 | Inaba et al. | 451/5 |
| 6,106,379 | A | 8/2000 | Mosca | 451/288 |
| 6,135,868 | A | 10/2000 | Brown et al. | 451/443 |
| 6,234,868 | B1 | 5/2001 | Easter et al. | 451/5 |
| 6,288,648 | B1 * | 9/2001 | Easter et al. | 340/635 |
| 6,327,540 | B1 | 12/2001 | Miyano et al. | 702/57 |
| 6,340,326 | B1 | 1/2002 | Kistler et al. | 451/286 |
| 6,361,423 | B1 | 3/2002 | Gurusamy et al. | 451/443 |
| 6,458,013 | B1 | 10/2002 | Saka et al. | 451/5 |
| 6,572,440 | B1 | 6/2003 | Moore | 451/5 |
| 6,585,559 | B1 | 7/2003 | Griffin et al. | 451/5 |
| 2003/0203624 | A1 | 10/2003 | Sameshima et al. | 438/687 |
| 2004/0138797 | A1 | 7/2004 | Yao et al. | 701/44 |

* cited by examiner

*Primary Examiner*—Robert A. Rose
(74) *Attorney, Agent, or Firm*—Martine Penilla & Gencarella, LLP

(57) ABSTRACT

Apparatus and methods control CMP to uniformly polish a series of wafers. Average motor current I(avg) drawn by, and related average work W(avg) performed by, motors during CMP on the wafers reliably indicate quality of a roughness polishing characteristic of a polishing surface of a polishing pad. A conditioner controller controls a rate at which the quality of the polishing surface is restored by conditioning in relation to a rate of change of the quality of the polishing surface due to the CMP. Motor current is measured and averaged over many CMP-processed wafers. The method defines a baseline range of values of average work and controls conditioning according to whether average work is within the baseline range. When the polishing surface moves at constant velocity relative to each of the wafers that are being polished, a control signal based on average motor current represents the quality of the polishing characteristic.

21 Claims, 9 Drawing Sheets

METHODS OF AND APPARATUS FOR CONTROLLING POLISHING SURFACE CHARACTERISTICS FOR CHEMICAL MECHANICAL POLISHING

BACKGROUND OF THE INVENTION

1. Field of the Invention

The present invention relates generally to controlling chemical mechanical polishing operations to provide uniform polishing of wafers, and more particularly to controlling a rate of roughening of a polishing surface in relation to a rate at which the polishing surface becomes smoother during chemical mechanical polishing operations performed on a series of wafers.

2. Description of the Related Art

In the fabrication of semiconductor devices, planarization operations are often performed on a semiconductor wafer ("wafer") to provide polishing, buffing, and cleaning effects. Typically, the wafer includes integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Patterned conductive layers are insulated from other conductive layers by a dielectric material. As more metallization levels and associated dielectric layers are formed, the need to planarize the dielectric material increases. Without planarization, fabrication of additional metallization layers becomes substantially more difficult due to increased variations in a surface topography of the wafer. In other applications, metallization line patterns are formed into the dielectric material, and then metal planarization operations are performed to remove excess metallization.

A chemical mechanical polishing (CMP) process is one method for performing wafer planarization. In general, the CMP process involves holding and contacting a rotating wafer against a polishing surface of a moving polishing pad under a controlled pressure. CMP apparatus typically configure the polishing pad on a rotary table or a linear belt to present the polishing surface to the wafer.

An exemplary CMP apparatus in accordance with the prior art may include a linear polishing pad configured to advance around spaced rollers. A platen is disposed opposite to the polishing surface of the polishing pad to support the polishing pad during a CMP operation. A wafer carrier is configured to hold and urge the wafer against the polishing surface of the polishing pad during the CMP operation. The wafer carrier is driven by a spindle that rotates the wafer while simultaneously urging the wafer against the polishing surface with an appropriate force. Slurry is introduced onto and distributed over the polishing surface of the polishing pad to facilitate and enhance the CMP operation. Additionally, a conditioner is used to condition the polishing surface of the polishing pad during the CMP operation.

An end point of a CMP operation performed on one particular wafer may be defined as the completion of removal of the excess metallization, such as copper, during a metal (e.g., copper) planarization operation performed on that one wafer. In the past, when one such CMP operation has been performed on such one wafer, such end point has been detected by measuring a current drawn by a motor that drives a transmission or other mechanical device connected to one of the spaced rollers around which the linear polishing pad extends. In this CMP operation on the one wafer with the exemplary copper metallization, a change in the current indicated the completion of removal of the copper from that one wafer. However, in such CMP apparatus having this type of end point detection, the current thus only indicated a change in the structure of the one wafer. Thus, apparatus for this end point detection was not configured to provide an indication of other aspects of the CMP operation, such as any effects of the CMP process on the CMP apparatus itself. As a result, motor current has not been relied upon commercially as an indicator of non-end point aspects of CMP operation.

In view of the foregoing, there is a need for improvements in CMP apparatus and methods in which motor current, and related work performed by such a motor during CMP operations, are reliable indicators of aspects of the CMP operations other than the structure of the one particular wafer that is being CMP processed.

SUMMARY OF THE INVENTION

Broadly speaking, the present invention fills these needs by providing improvements in CMP apparatus and methods by which the use of motor current, and related work performed by such a motor, during CMP operations on a series of wafers are reliable indicators of non-end point aspects of the CMP operations, e.g., aspects other than the structure of the wafer being CMP processed. Such non-end point aspects include, for example, the roughness of a polishing surface that is applied to a series of wafers during ongoing CMP operations. The present invention enables control of a rate of conditioning, e.g., roughening, of the polishing surface in relation to a rate at which the polishing surface becomes smoother during CMP operations performed on such series of wafers.

It should be appreciated that the present invention can be implemented in numerous ways, including as a process, an apparatus, a system, a device, or a method. Several inventive embodiments of the present invention are described below.

In one embodiment, there is provided a CMP apparatus in which a drive of a CMP apparatus is provided for one of the carrier and the polishing surface, and circuitry is connected to the drive for measuring values of power used by the drive during CMP of a series of the wafers, the circuitry generating a control signal indicative of whether a polishing characteristic of the polishing surface is within an acceptable range during the CMP of the series of the wafers.

In another embodiment, the drive is further configured with a motor having a rotor and a 1:1 connection of the rotor to the one of the carrier and the polishing surface, the motor being operated in response to power used by the motor during CMP operations.

In yet another embodiment in which the motor current is measured, the polishing surface is moved at a constant velocity relative to each of the wafers of the series of wafers that are being polished, and a control signal is generated proportional to an average current drawn by the drive, and the average current represents the quality of the polishing characteristic of the polishing surface.

In still another embodiment, the polishing surface is configured with a polishing characteristic having a quality that tends to change from a first value during performance of the CMP process on a series of the wafers, wherein the quality is restorable to the first value during an operational life of the polishing surface, and the CMP apparatus includes a conditioner to perform the restoration, a detector to measure an amount of work performed by a drive during successive periods of time during the performance of the CMP process on the series of the wafers, the detector being configured to output a control signal having signal values indicative of the amount of the work performed, wherein there is a controller responsive to the control signal for controlling the conditioner so that the polishing characteristic is rendered uniform during the performance of the CMP process performed on the series of the wafers during the operational life of the polishing surface, the conditioner being controlled to offset the tendency of the quality to change from the first value during the performance of the CMP process on the series of the wafers during the operational life of the polishing surface.

In a further embodiment, a method is provided for controlling conditioning of a chemical mechanical polishing (CMP) polishing surface during performance of a CMP process on a series of wafers, wherein the method may include operations of monitoring values of average work performed during the CMP processing of the series of the wafers, and conditioning the CMP polishing surface during the CMP processing of the series of wafers and according to the values of the monitored average work.

In a yet further embodiment, the method may also include defining a baseline range of the values of the average work performed, and controlling the conditioning operation according to whether the monitored values of the average work performed are within the baseline range.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements.

The accompanying drawings, which are incorporated in and constitute part of this specification, illustrate exemplary embodiments of the invention and together with the description serve to explain the principles of the invention.

DETAILED DESCRIPTION OF THE PREFERRED EMBODIMENTS

An invention for a system and method for controlling chemical mechanical polishing operations to provide uniform polishing of wafers is described. In preferred embodiments of the present invention, improvements in CMP apparatus and methods are provided in which motor current, and related work performed by a motor, during CMP operations on a series of wafers are reliable indicators of aspects of CMP operations other than the structure of one wafer that is CMP processed. These aspects include roughness, which is a polishing characteristic of a polishing surface, e.g., of a polishing pad that is applied to the series of wafers during ongoing CMP operations. The improvements enable control of a rate of conditioning of the polishing surface in relation to a rate at which the polishing surface becomes less effective for polishing during CMP operations performed on the series of wafers.

In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to obscure the present invention.

As an overview, in connection with the present invention there was a review of problems impeding effective control of CMP operations. That review sought to provide uniform polishing of a series of wafers. The series of wafers may represent a large number of wafers, such as many tens of wafers in the series (e.g., between ten and 100 wafers in the series). Further, there may be a tight tolerance for CMP processing of every wafer in the large series. With respect to CMP operations on the described series of wafers using the present invention, reference is made to FIG. 1, which is a graph illustrating average work W(avg) during CMP processing of the series of wafers vs. time during CMP processing of the series of wafers. These wafers may be wafers used for actual commercial production of semiconductor devices (not shown), for example, and are represented by the wafer 200 shown in FIG. 2B.

Figure 1:
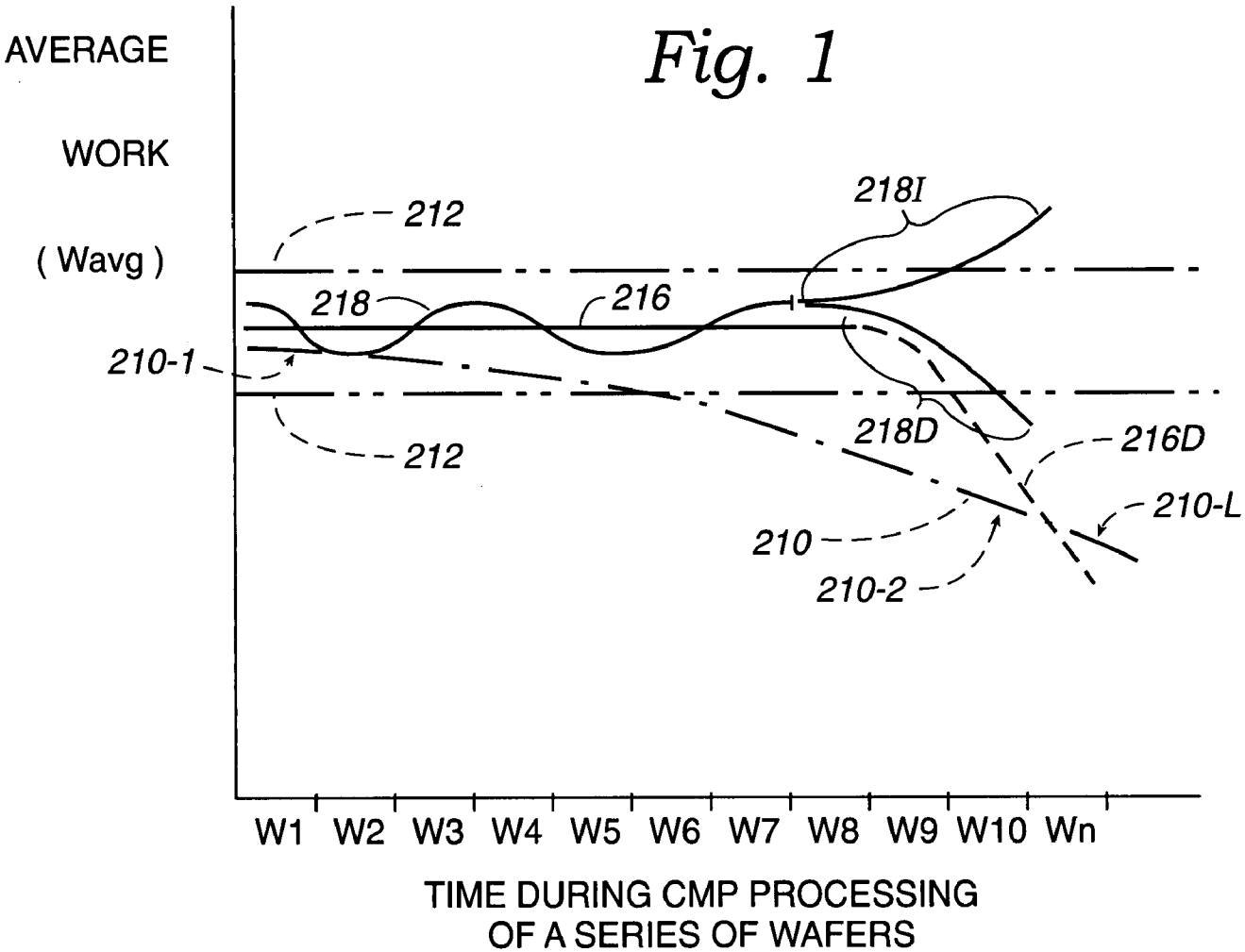
FIG. 1 is a graph illustrating average work during CMP processing of a series of wafers vs. time during CMP processing of the series of wafers according to the present invention, showing a baseline range of values of the average work.

It may be understood that there is an average current I(avg) drawn by the motor of the present invention during the CMP operations performed on the series of wafers 200. W(avg) may be obtained from the average current I(avg) times the average voltage V(avg) at which the average current I(avg) is supplied during the CMP operations performed according to the present invention on the series of wafers 200. FIG. 1 shows average work W(avg) performed by such motor during the CMP operations performed on the series of wafers. In more detail, during those CMP operations, the friction at an interface between a polishing surface 202 of a polishing pad 204 (FIG. 2A) and each of the wafers 200 imposes a load on the motor. The motor draws current I to effect polishing of the wafer. As wafers 200 of the series of wafers are polished, the values of that current I are averaged, and a value of the averaged current I(avg) is determined. For example, the averaging of the current I may be performed over a first group of 25 of the wafers that are polished, and a first I(avg) determined. This averaging is repeated for each of the next groups of the 25 exemplary wafers of the series, and successive values of the average current I(avg) are determined. Each value of the I(avg), e.g., corresponding to the first, second, etc. I(avg), is converted to a corresponding value of the W(avg). Exemplary ones of such values of W(avg) are shown in FIG. 1. As explained in more detail below, in the present invention each of the values of the I(avg) and W(avg) represents a polishing characteristic of the polishing surface 202, such as the roughness polishing characteristic. Changes in the polishing characteristic are thus indicated by changes in the values of the I(avg) or in the W(avg) over time during the CMP of the series of wafers 200.

Still referring to FIG. 1, it may be understood that the polishing surface 202 of the polishing pad 204 (shown in FIG. 2A) is movable in relation to and in contact with the wafer 200 to perform the CMP operations. The polishing surface 202 may be configured with the polishing characteristic. An exemplary polishing characteristic for purposes of illustrating the present invention is the roughness of the polishing surface 202. The polishing characteristic, e.g., roughness, is described as having a quality that is related to the CMP process. For example, as the polishing surface 202 is moved in relation to and in contact with the wafer 200, friction is generated between the polishing surface 202 and materials (not shown) in a surface 206 of a semiconductor substrate 208 of the wafer 200 (FIG. 2B). The friction removes a portion of the materials from the surface 206 of the semiconductor substrate 208. This friction and the removed material affect, or change, the quality of the polishing characteristic of the polishing surface 202, including the roughness. The effect on the exemplary roughness may be to either increase or decrease the roughness, for example, which in a general sense is referred to as the above-described "change" in the quality of the polishing characteristic. Such quality change is observed over time as the CMP process is performed on the series of wafers 200. As described above, the values of the I(avg) and W(avg) corresponding to performing CMP on successive groups of the wafers 200 of the series indicate the quality change of the polishing surface as those successive groups are subjected to the CMP operations. Thus, the quality change may be said to occur at a first rate R(q).

In FIG. 1 the quality change is shown by a curve 210 having values of W(avg) that vary in an exemplary manner during performance of the CMP process on the series of the wafers 200. The exemplary variation is indicated by values of the average work W(avg) that define the curve 210, and may vary from a first (shown higher) value 210-1 to a second (shown lower) value 210-2. The rate R(q) is thus shown in FIG. 1 as an exemplary decreasing rate, referred to as R(qd), whereas the quality change may also be characterized by an increasing rate referred to as R(qi). A range of acceptable quality of the polishing surface 202 is illustrated in FIG. 1 by quality limits, or limits, 212, described below. FIG. 1 shows the curve 210 having a portion within the limits and a portion outside the limits.

The values of the limits 212, and thus the magnitude of the acceptable quality range, are based at least in part on a feature of the polishing characteristic by which the quality of the polishing surface 202 (e.g., the roughness) may be "restored" during an operational life of the polishing pad 204. Restoration of the quality is described initially in terms of a value 210-L of the curve 210 that is low (corresponding to an exemplary wafer Wn). To "restore" the quality, a conditioner (such as the conditioner 214 shown in FIG. 5) operates on the polishing surface 202. By such conditioner operation, the roughness may be changed (e.g., increased) from the low value 210-L to the first value 210-1, for example. Also, such restoration from the exemplary low value 210-L to the exemplary first value 210-1 may occur at a second rate (Rr). In in situ conditioning, restoration may occur during the time in which the series of wafers 200 is CMP processed, for example. If by conditioner operation the roughness is increased, the increase may be at a rate R(ri), or if the roughness is decreased, the decrease may be at a rate R(rd).

Changes in such quality have effects on the uniformity of the CMP operations. For example, consider the exemplary decrease in roughness as an example of a change in such quality. Also consider a fixed, or given, so-called CMP "recipe". Such recipe may specify details of the CMP process to be performed, e.g., on all of the wafers 200 of the series of wafers 200, or on first (and next) series of the wafers 200 of the series (see paragraphs [0058] and [0059] below). With such quality change, and using the fixed CMP recipe, in a unit of polishing time (e.g., one minute) an exemplary decreasing change of the quality will result in less material being removed in each such one minute from the surfaces 206 of the substrates 208 of the last tens of the series of wafers 200 than will be removed in each such one minute from the surfaces 206 of the substrates 208 of the first tens of the series of wafers 200. This difference in such polishing surface quality (and resulting difference in removal) produces non-uniformities of the CMP processing from one wafer to a next wafer of the wafers 200 of the series of wafers, and is objectionable. Therefore, a conditioner such as conditioner 214 (FIG. 5) is used to restore the quality.

FIG. 1 also illustrates one result of such exemplary decrease of quality (and roughness) of the polishing surface 202. The curve 210 shows a decrease in the average work W(avg) used to CMP process that exemplary series of wafers 200. That decrease occurs during the period from the initially-processed wafers (e.g., W1, W2) to the later-processed wafers (e.g., W8, Wn). Curve 210 corresponds to the CMP process performed without use of any conditioner, i.e., without use of the conditioner 214 described below with respect to FIG. 5.

In a most preferred embodiment of the present invention, when the conditioner 214 is used, the first rate R(q) of change of the quality due to the CMP processing may be substantially equal to the second rate R(r) of restoration, such as when the restoration is performed in situ (e.g., continuously) during the time period in which the series of wafers 200 is CMP processed. This simultaneous operation of the polishing pad 204 for CMP processing and of the conditioner 214 for quality restoration is illustrated by a solid-line portion of curve 216 in FIG. 1. The relatively constant average work W(avg) of that solid-line portion of curve 216 may, for example, result from automatic control of the conditioner 214 acting on the polishing surface 202 during the CMP operations on the series of wafers 200.

In a more preferred embodiment, the first rate R(q) may be substantially less than the second rate R(r) of restoration, such as when the conditioner 214 is used ex situ, in which the restoration is thus performed periodically, rather than continuously during the entire time period in which the series of wafers 200 is CMP processed. The result of this ex situ operation of the polishing pad 204 for CMP processing and operation of the conditioner 214 for quality restoration is illustrated by curve 218 in FIG. 1.

Conditioners such as conditioner 214 may be described as having an ability to restore the quality of the polishing surface 202 to the original quality, or close enough to the original quality, to permit continued use of the polishing pad 204 during the operational life of the pad 204. At an end of such operational life, the polishing surface 202 has deteriorated to an extent that the conditioner 214 is no longer able to restore the quality to an acceptable quality. This situation is shown by a portion 216D of curve 216. A main portion of curve 216 (corresponding to processing of wafers W1 through W7) is within the limits 212. However, portion 216D indicates that at end of operational life, even though the conditioner 214 is, for example, being used in situ (continuously) during the CMP processing, the rate R(qd) of decrease of the quality (due to the CMP processing) is too much greater than the rate R(ri) of the conditioning caused by the conditioner, such that in use of the polishing surface 202 the average work W(avg) decreases. Portion 216D of curve 216 decreases to values that are outside of the limits 212. Since the average work W(avg) is an indication of the quality, the exemplary values of W(avg) outside the limits 212 indicate that at the end of operational life of the polishing surface 202 the polishing pad 204 must be changed. As described below, the present invention senses a tendency, or trend (e.g., a decrease or an increase) in the average work W(avg), which if continued would result in the values of the average work being outside the limits 212. The sensing of this tendency enables the CMP process to be stopped before the average work W(avg) is outside either of the limits 212.

FIG. 1 also shows that the average work W(avg) may indicate other events that may occur during a CMP operation. Curve 218 depicts an average work W(avg) that is variable but always within the baseline range of the SPC limits 212 until the occurrence of a problem in the CMP operations. The exemplary problem is shown occurring at about the time of processing of wafer W7. At that time, there should still be time left in the operational life, and the conditioner 214 should still be operating properly (i.e., to continue restoring the quality of the polishing surface 202 to the original quality, or close enough to the original quality, to permit continued use of the polishing pad 204 during the operational life of the pad 204). However, a portion 2181 of the curve 218 indicates a sudden increase in the average work W(avg) required to process wafers W8, W9, etc. Such sudden increase may, for example, be indicated by the curve 218, for example, being within the baseline range, or limit 212 at the time of CMP processing of the one wafer W7, and then the portion 2181 of the exemplary curve 218 being outside the limit 212 at the time of CMP processing of the wafers W10, etc., . . . Wn. The sudden increase may, for example, indicate loss of a supply of slurry, which loss of supply results in an increase in friction at the wafer-polishing surface interface. In an opposite manner, when there should still be time left in the operational life, and when the conditioner 214 should still be operating properly, a portion 218D of the curve may indicate a sudden decrease in the average work W(avg). Such sudden decrease may, for example, indicate inefficient conditioning, resulting in a decrease in friction at the wafer-polishing surface interface.

Figure 2A:
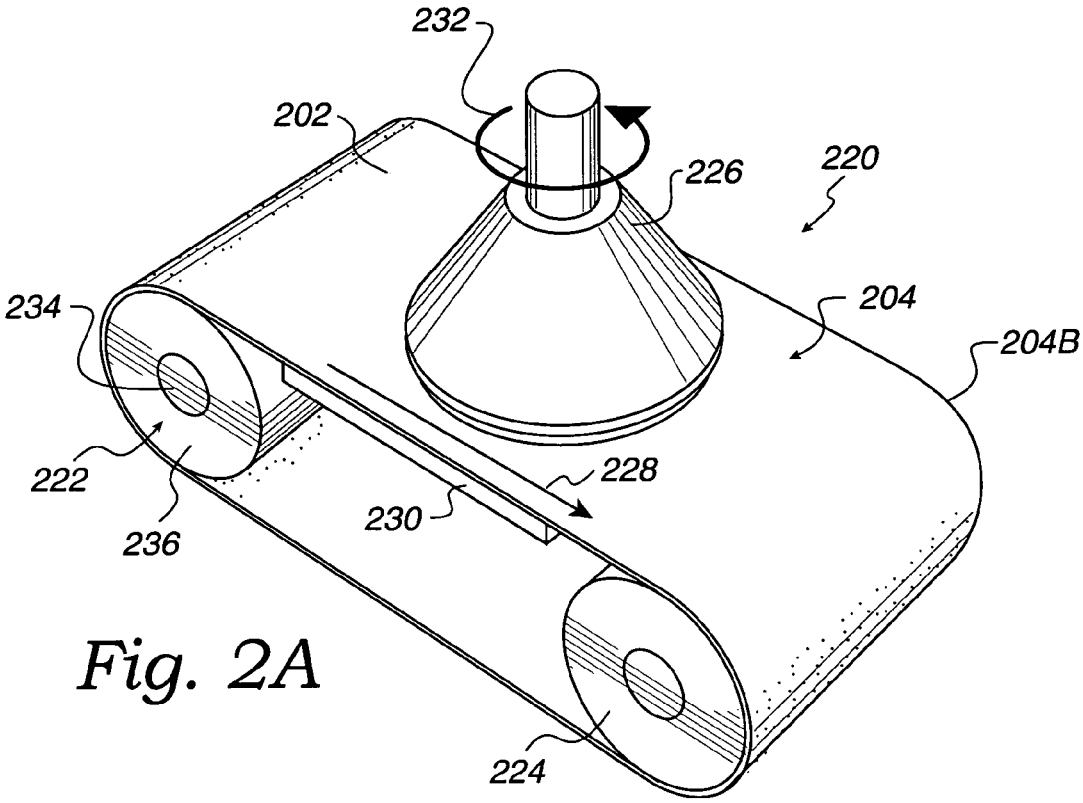
FIG. 2A is a schematic diagram illustrating an apparatus for performing CMP operations on a series of wafers, showing the motor of the present invention directly driving a polishing surface formed on an elongated polishing belt.
Figure 2B:
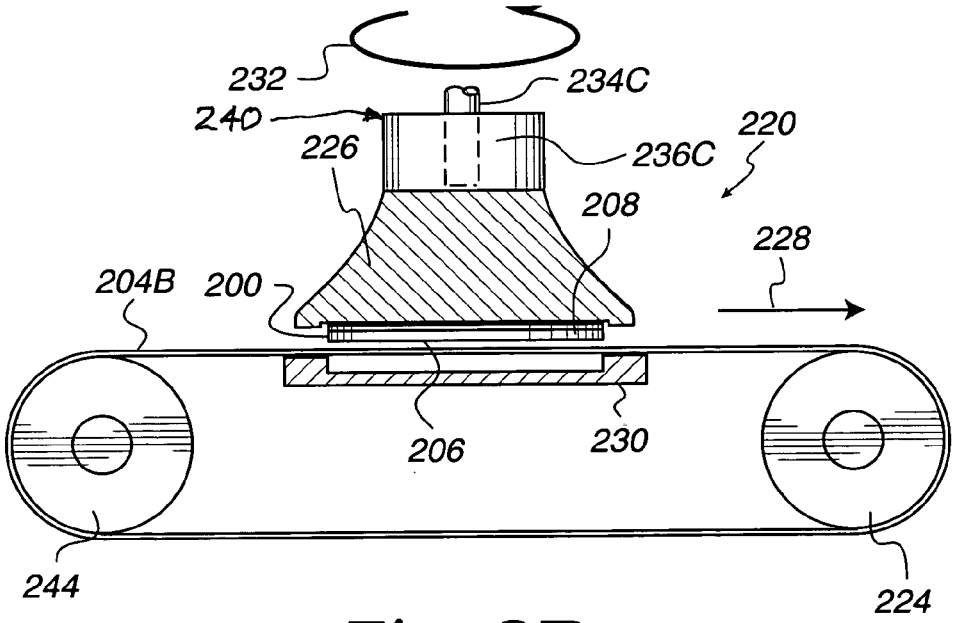
FIG. 2B is a schematic diagram illustrating an apparatus for performing CMP operations on a series of wafers, showing the motor of the present invention directly driving a wafer carrier.

Referring now to FIG. 2A, a schematic diagram illustrates a CMP apparatus 220 of the present invention for performing CMP operations on a series of the wafers 200 (FIG. 2B), showing a motor 222 of the present invention directly driving the polishing surface 202 formed on an exemplary polishing pad 204, which is in an exemplary form of an elongated polishing belt 204B. The motor 222 is shown spaced from an idler pulley 224. With the belt 204B in an endless configuration, and mounted to contact both the motor 222 and the idler pulley 224, an upper length of the belt 204B is caused to advance past a wafer carrier 226 in a direction shown by arrow 228. A platen 230 may urge the inner side of the belt 204B upwardly to resist downward force exerted by the carrier 226. The carrier 226 rotates the wafer 200 (arrow 232) with the wafer 200 pressed against the polishing surface 202 to perform the CMP process on the wafer 200.

In one embodiment of the present invention, a so-called motor configuration is the configuration of the motor 222 shown in FIG. 2A for example, which enables use of the average current I(avg) drawn by the motor 222, and average work W(avg) performed by the motor 222, to indicate the quality of the polishing surface 202. With respect to this embodiment, FIG. 2A shows the motor 222 configured with a stator, or central shaft, 234 on which an outer rotor 236 is mounted for rotation. The motor 222 may be a three phase brushless dc motor-amplifier, for example, such as that supplied by Kollmorgan. For use in the present invention, the motor 222 is configured so that the outer diameter of the rotor 236 is dimensioned as required to engage the inner side of the belt 204B and stretch the belt across the space between the rotor 236 and the idler pulley 224, so that rotation of the rotor 236 will advance the belt 204B as described above (arrow 228). This configuration of the motor 222 avoids use of any extra mechanical system or mechanism between the rotor 236 and the belt 204B, and is said to be a "direct" connection between the motor 222 and the belt 204B. Moreover, such direct connection provides a 1:1 connection, which, for example, is a motor 222-to-belt 204B connection in which one rotation of the rotor 236 results in one advancement of the belt 204B by a distance equal to one circumference of the rotor. Thus, the 1:1 connection provides a 1:1 turning ratio. In this manner, the motor 222, via the rotor 236 in direct contact with the belt 204B, directly drives the belt 204B, increases the sensitivity of the average motor current I(avg) to friction at the interface between the polishing surface 202 and the surface of the wafer 200, and enables use of the average current I(avg) and average work W(avg) to indicate the quality of the polishing surface 202.

In another embodiment of the present invention shown in FIG. 2B, this motor configuration also increases the sensitivity of the average motor current I(avg) to friction at the interface between the polishing surface 202 and the surface of the wafer 200, and enables use of the average current I(avg) and average work W(avg) to indicate the quality of the polishing surface 202. FIG. 2B shows a motor 240 positioned for rotating the carrier 226 and the wafer 200 during the CMP processing. To designate use with the carrier 226, the motor 240 is described using the letter "C" with the reference numbers that designate the structural elements of the motor 222. The motor 240 is configured with a stator, or central shaft, 234C on which an outer rotor 236C is mounted for rotation. The motor 240 may be the same type as motor 222. For use in the present invention, the motor 240 is configured so that the lower portion of the rotor 236C is dimensioned as required to be directly fixed to and support the top of the carrier 226. The carrier 226 extends downwardly from the rotor 236C to mount and urge the rotating wafer 200 against the polishing surface 202. This configuration of the motor 240 also provides the 1:1 connection and 1:1 turning ratio described above, and is also said to be a "direct" connection between the motor 240 and the carrier 226. In this manner, the motor 240, via the rotor 236C in direct contact with the carrier 226, directly rotates the carrier. In this embodiment, the average motor current I(avg) drawn by the motor 240 is determined. Also, the belt 204B may be driven by a conventional motor 244 when it is not desired to have the above-described advantages of the motor 222, which may be provided instead by the motor 240 rotating the carrier 226.

Figure 2C:
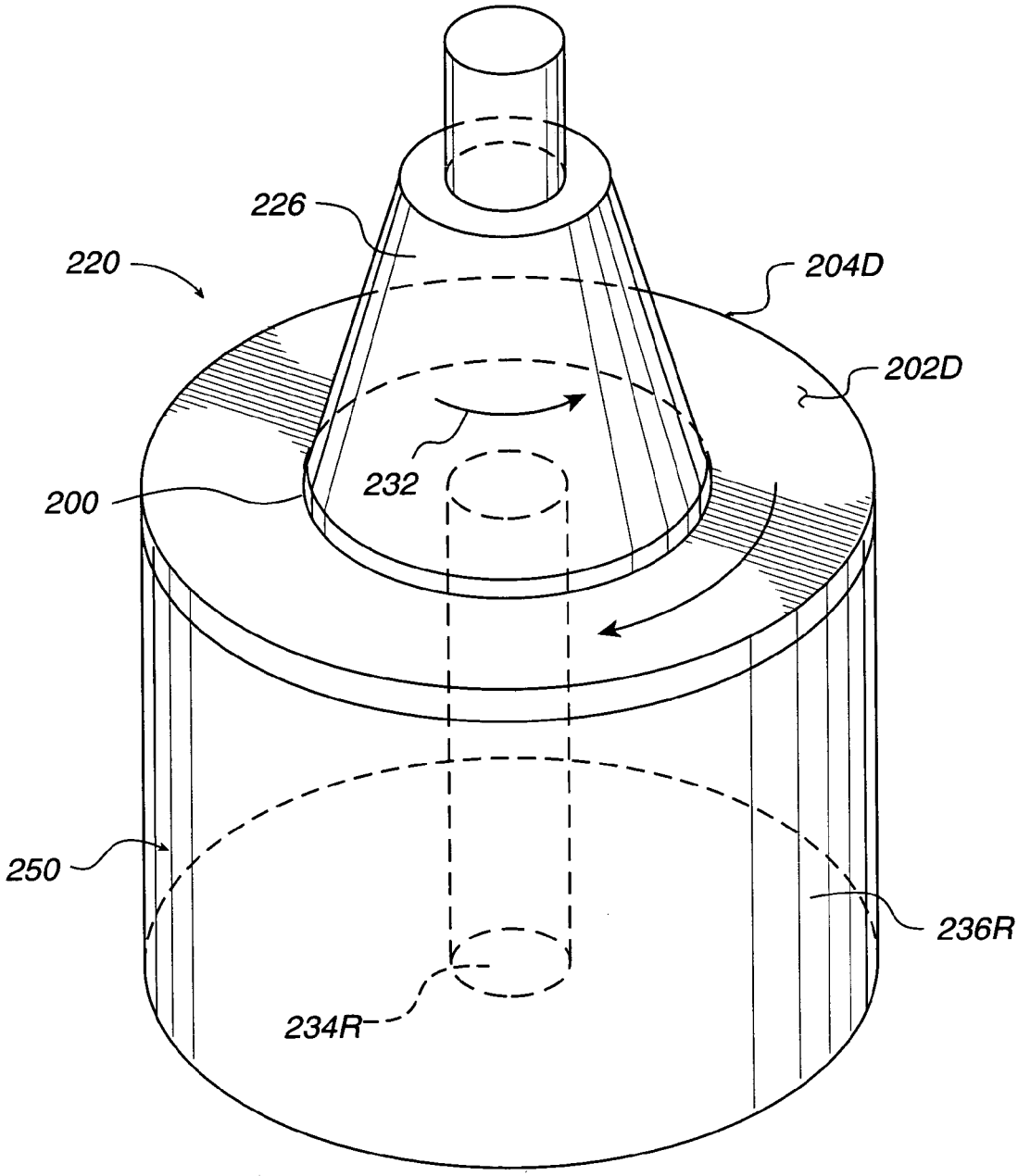
FIG. 2C is a schematic diagram illustrating an apparatus for performing CMP operations on a series of wafers, showing the motor of the present invention directly driving a polishing surface formed on a rotary polishing pad.

In yet another embodiment of the present invention shown in FIG. 2C, this motor configuration also increases the sensitivity of the average motor current I(avg) to friction at the interface between the polishing surface 202 and the surface of the wafer 200, and enables use of the average current I(avg) and average work W(avg) to indicate the quality of the polishing surface 202. FIG. 2C shows this motor configuration as the configuration of the motor 250. FIG. 2C shows the motor 250 as part of a different configuration of the CMP apparatus 220 in which the polishing pad 204 has a disk shape and is rotated below a carrier 226 of the type shown in FIG. 2A. FIG. 2C shows this polishing pad as a polishing pad 204D including the polishing surface 202D positioned horizontally below the carrier 226. The motor 250 is described using the letter "R" (to designate use with the rotary polishing pad 204) with the reference numbers that designate the structural elements of the motor 222. The motor 250 is configured with a vertical stator, or central shaft, 234R on which a vertical outer rotor 236R is mounted for rotation. The motor 250 may also be of the same type as the motor 222. For use in the present invention, the motor 250 is configured so that the upper portion of the rotor 236R is directly fixed to and supports the polishing pad 204D with the polishing surface 202D in position to contact the rotating wafer 200 for CMP polishing. In this embodiment, the carrier 226 may be driven by a conventional motor (not shown) when it is not desired to have the above-described advantages of the motor 222, which advantages may be provided instead by the motor 250. This configuration of the motor 250 also avoids use of any mechanical system or mechanism between the rotor 236R and the polishing pad 204D, and is thus also said to be a "direct" connection, and a 1:1 connection and turning ratio, between the motor 250 and the polishing pad 204D. In this manner, the motor 250, via the rotor 236D in direct contact with the polishing pad 204D, directly rotates the polishing pad. In this embodiment, the average motor current I(avg) drawn by the motor 250 is determined. In view of the configurations of the motors 222, 240 and 250, it may be said that these motors provide a drive for one of the carrier 226 and the polishing surface 202 of the polishing pad 204, which may be in the form shown in FIG. 2A or 2B, or in FIG. 2C, for example.

Figure 3:
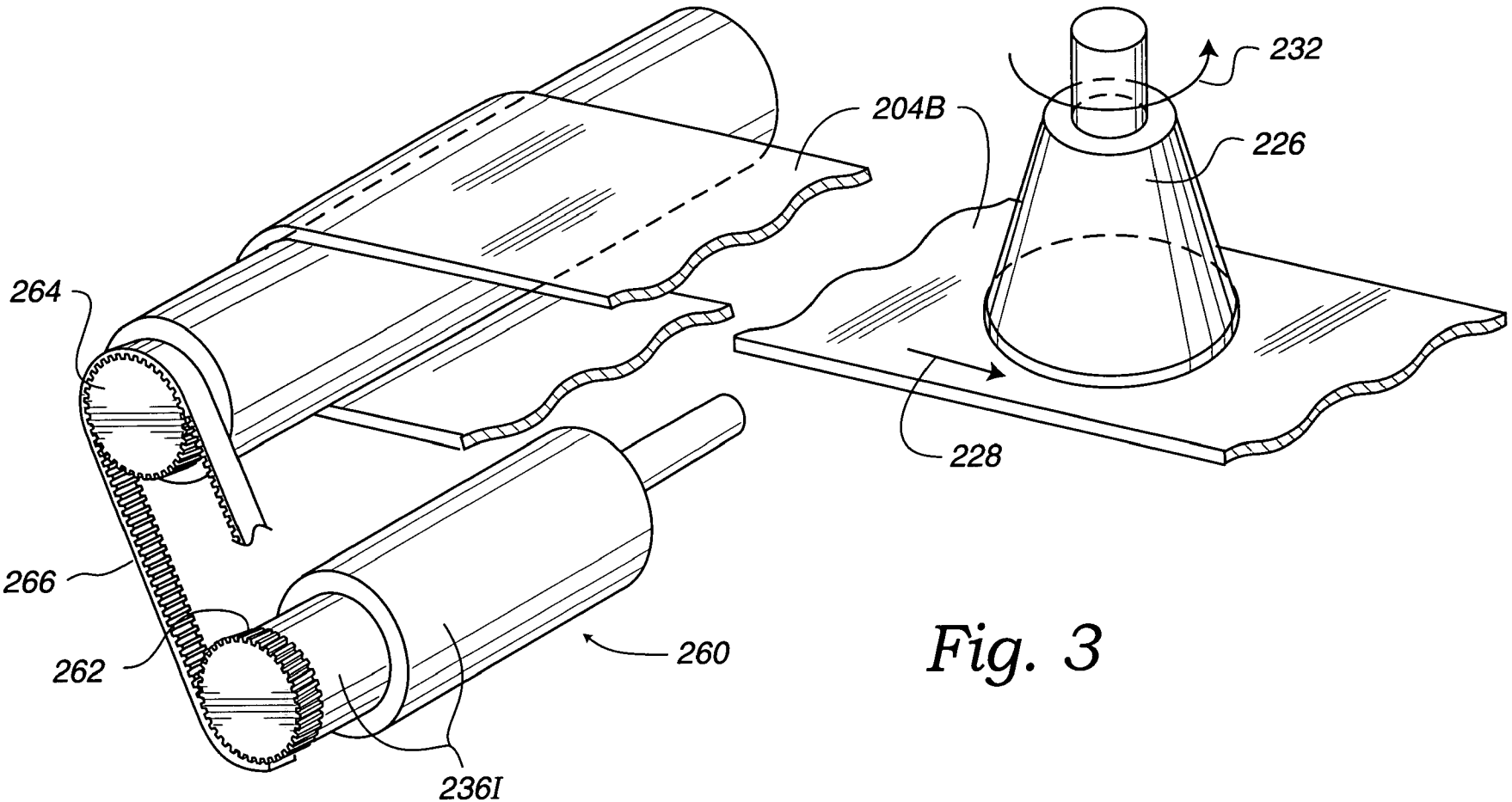
FIG. 3 is a schematic diagram illustrating an apparatus for performing CMP operations on a series of wafers, showing the motor of the present invention indirectly driving a polishing surface via a 1:1 connection.

In a further embodiment of the present invention shown in FIG. 3, this motor configuration also increases the sensitivity of the average motor current I(avg) to friction at the interface between the polishing surface 202 and the surface of the wafer 200, and enables use of the average current I(avg) and average work W(avg) to indicate the quality of the polishing surface 202. FIG. 3 shows the configuration of the motor 260 as part of a configuration of the CMP apparatus 220 which provides the 1:1 connection in an indirect manner. The motor 260 is configured with a connection of the rotor 236I to a first drive gear 262, which is connected to a second drive gear 264 by a drive belt 266. Because this connection between the rotor 236I and the belt 204B is not as direct as in the above "direct" examples, there is said to be an "indirect" connection between the motor 260 and the belt 204B. However, because the number of teeth of the drive gears 262 and 264 are the same, the configuration of the drive (comprising the motor 260, the drive gears 262 and 264, the belt 204B, and the drive belt 266) also provides the 1:1 connection between the motor 260 and the belt 204B. In this manner, the motor 260, via the rotor 2361 in indirect relation with the belt 204B is suitable to have the average motor current I(avg) drawn by the motor 260 be determined for providing the average work W(avg) as shown in FIG. 1.

Figure 4:
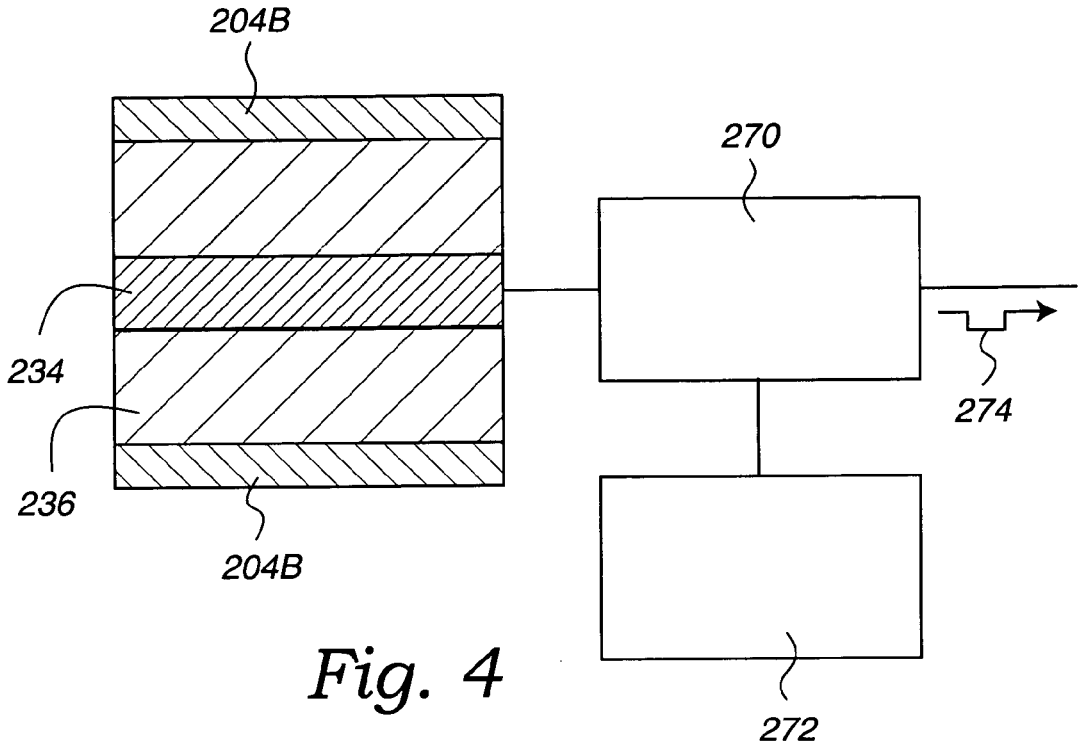
FIG. 4 is a schematic diagram illustrating apparatus according to the present invention, showing circuitry for measuring the work performed by a motor during CMP processing of a series of wafers.

FIG. 4 is a schematic diagram illustrating the CMP apparatus 220, showing a detector, or circuitry, 270 for measuring the total average current I(avg) drawn by all three phases of the respective motor 222, 240, 250, or 260, so as to obtain the average work W(avg) performed by all three phases of the respective motor during CMP processing of the series of wafers 200. The circuitry 270 is used in conjunction with a power supply 272 that supplies power to the respective motors 222, 240, 250, or 260. In response to the power, the respective motor 222, 240, 250, or 260 drives the respective belt 204B, or carrier 226, or polishing pad 204D, or belt 266 for the CMP operations on the series of wafers 200. During those operations, the friction at the interface between the polishing surface 202 and the wafer 200 imposes the above-described load (the "motor load") on the respective motor. The circuitry 270 measures the current I drawn by the respective motor and averages the current I as described above to determine the average current I(avg). Based on I(avg) and the corresponding V(avg) measured by the circuit 270, the circuitry 270 determines the average work W(avg) described with respect to FIG. 1 (i.e., the average work W(avg)) performed by the respective motor during the CMP operations performed on the series of wafers. In detail, W(avg) is obtained from the average current I(avg) times the average voltage V(avg) at which the average current I(avg) is supplied by the power supply 272 during the CMP operations performed on the series of wafers 200. As described above, with respect to the time period in which the CMP process is performed on successive groups of wafers of the series of wafers 200, values of the I(avg) may be determined with respect to such processing performed on each of the exemplary groups of wafers of the series. For each group, the circuitry determines the corresponding average work W(avg). The circuitry 270 generates a control signal 274 having values corresponding to these values of the average work W(avg). The drive with the configuration of the respective motor 222, 240, 250, or 260 thus draws the current I, the circuit 270 determines the average current I(avg) and the average work W(avg), and the 1:1 connection of the drive enables the control signal 274 to have a high signal to noise ratio so that the control signal 274 indicates the quality of the polishing characteristic 202 of the polishing surface 204.

In more detail, the control signal 274 may be indicative of the average work W(avg) in those embodiments of the CMP apparatus 220 in which the operating velocity of the respective belt 204B, or rotating carrier 226, or rotating polishing pad 204D, or drive belt 266, is not controlled so as to be constant. In other embodiments of the CMP apparatus 220 in which the operating velocity of the respective belt 204B, or rotating carrier 226, or rotating polishing pad 204D, or drive belt 266, is controlled so as to be constant, the control signal 274 may be indicative of the average current I(avg). In each case, because of the above-described configuration of the drive, e.g., of the respective motors 222, 240, 250, or 260 (according to which is used in the current embodiment), the control signal 274 is indicative of whether the polishing characteristic of the polishing surface 202 is within an acceptable range. Such range is represented by the limits 212 shown in FIG. 1, for example.

Specific pairs of the limits 212 may be established for particular CMP process variables that are to be specified. These variables include the following, for example. The configuration of the respective motor 222, 240, 250, or 260 that is used in conjunction with the circuitry 270, and the particular CMP polishing pads 204 that are to be used. Pad variables relate to the nature of the polishing characteristic quality (e.g., the nature of the roughness) of the polishing surfaces 202, including the operating life of the polishing surface 202, the rate R(q) at which a particular (or selected) CMP operating recipe may change the quality, and the rate R(r) at which the particular conditioner 214 may restore the polishing pad 202, for example. Other variables are the wafer features (e.g., the materials and patterns that will be on the wafers 200 to be CMP processed), and the characteristics of the slurry. Also, a selected one of the in situ (continuous) conditioning and ex situ (periodic) conditioning embodiments may be used.

With the apparatus 220 set up according to particular ones of these variables, the limits 212 may be established using wafers 200 having the desired wafer features. Such wafers 200 are of the type of wafers 200 that are to be processed using the particular CMP recipe. For establishing the limits 212, the circuitry 270 is used to measure the current I drawn by the respective motor 222, 240, 250, or 260 during this CMP processing, and the circuitry 270 determines the I(avg) and W(avg). Statistical process control (SPC) may be used to define a normal operating range for the average current I(avg), which may be referred to as a "baseline range". The limits 212 may be stated in terms of this baseline range of average current I(avg), or as shown in FIG. 1 in terms of the average work W(avg). The wafers 200 processed with the I(avg) or the W(avg) in this baseline range have acceptable wafer quality. Such SPC may be as described in a text entitled "JURAN'S QUALITY HANDBOOK", Joseph M. Juran, A. Blandon Godfrey, 1998. The duration of this CMP processing is enough to allow the friction generated between the polishing surface 202 and the materials (not shown) in the surface 206 of the semiconductor substrate 208 of the series of wafers 200 to affect the quality of the polishing characteristic of the polishing surfaces 202 as described above in respect to FIG. 1.

Whether stated in terms of I(avg) or W(avg), the established SPC limits 212 may then be used during commercial CMP operations performed on wafers 200 to be used commercially. In such commercial CMP operations the same variables are used as were used in establishing the limits 212. In the event that I(avg) or W(avg) determined during such commercial CMP operations is within the limits 212, then such respective I(avg) or W(avg) indicates that the quality of the polishing surface 202 is suitable for making wafers 200 that meet the commercial specifications corresponding to those used to establish the limits 212.

Figure 5:
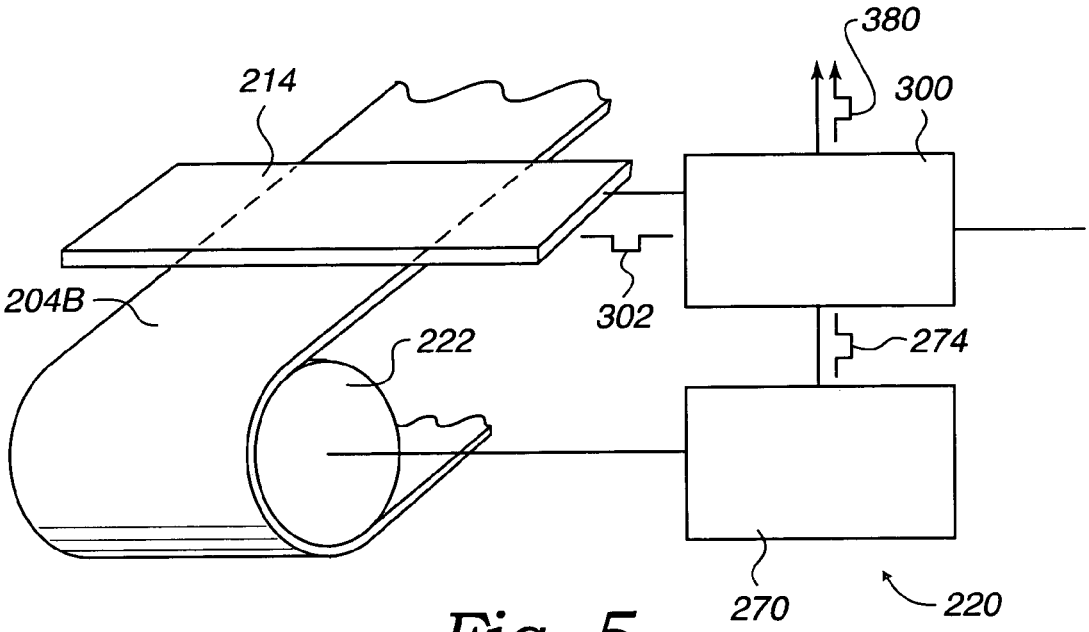
FIG. 5 is a schematic diagram illustrating apparatus according to the present invention for maintaining uniformity of a polishing characteristic of a polishing surface, showing circuitry for measuring the average current drawn by the motor during the CMP processing of the series of wafers, and a conditioner controller responsive to the average current for controlling conditioning of the polishing surface.

With respect to FIG. 1, reference is made to FIG. 5, which is a schematic diagram illustrating the CMP apparatus 220 for maintaining uniformity of the polishing characteristic of the polishing surface 202. FIG. 5 shows the circuitry 270 for measuring the current I drawn by the respective motor 222, 240, 250, or 260 during the CMP processing of the series of wafers 200, and for determining the corresponding I(avg) and W(avg), according to which embodiment is used. The control signal 274 from the circuitry 270 is applied to a conditioner controller 300. According to which type of control signal 274 is applied to the conditioner controller 300, the conditioner controller 300 thus responds to the average current I(avg), or the W(avg), for controlling conditioning of the polishing surface 202 by the conditioner 214. In the operation of the CMP apparatus 220 shown in FIG. 5, the controller 300 may determine that there is a trend of changing quality, i.e., a tendency of the quality of the polishing characteristic (e.g., roughness) to change, such that such quality tends to change during the CMP processing of the series of the wafers 200. In this event, if that trend is not reversed as the CMP processing of the series of wafers 200 continues, the I(avg) determined by the circuitry 270 during such commercial CMP operations will no longer be within the limits 212. When this tendency is determined by the controller 300, the controller 300 outputs conditioner control signals 302 to the conditioner 214. In response to the signals 302, the conditioner 214 operates according to the selected recipe to restore the polishing pad 204 so that the I(avg) determined by the circuitry 270 will remain within the limits 212. In this manner, the I(avg) will continue to indicate that the quality of the polishing surface 202 is suitable for making the series of the wafers 200, wherein each such wafer 200 meets the specifications corresponding to those used to establish the limits 212.

In more detail, an initial response of the conditioner 214 to the control signal 302 is to start conditioning according to the conditioning recipe established in conjunction with the establishment of the limits 212. Such conditioning may be either of the in situ or ex situ conditioning. If notwithstanding the operation of the conditioner 214 per the selected recipe, for example, the tendency of changing quality continues without the I(avg) being outside the limits 212, then the controller 300 senses this continued tendency before the I(avg) changes enough to be outside the limits 212. The controller 300 changes the conditioning operation from the selected recipe to a modified recipe. Thus the controller 300 may configure the control signal 302 to cause the conditioner 214 to make one or more real-time changes to comply with the modified recipe, e.g., by changing the force by which a conditioning puck is urged against the polishing surface 202, or by indexing into operation a different conditioning puck, for example. If notwithstanding this modified conditioning operation the tendency of changing quality continues (such that the I(avg) will very soon be outside the limits 212), then for example the controller 300 may stop the CMP operation, so that a new polishing pad 204 may be provided. Such change of the polishing pad 204 may be in conjunction with a determination by the controller 300 that an end of operating life has occurred in regard to the current polishing surface 202 of the current polishing pad 204. The provision of the new polishing pad 204 results in the next polishing surface 202 being configured with a proper polishing characteristic. In this manner, in a continuous conditioning situation, for example, and upon resuming CMP processing, the following may result. A rate R(qd) of an exemplary decrease of the quality (e.g., from a first, or high, value due to the CMP process) may be substantially equal to a rate R(ri) of an exemplary increase of the quality due to the restorative action of the conditioning operation.

Figure 6A:
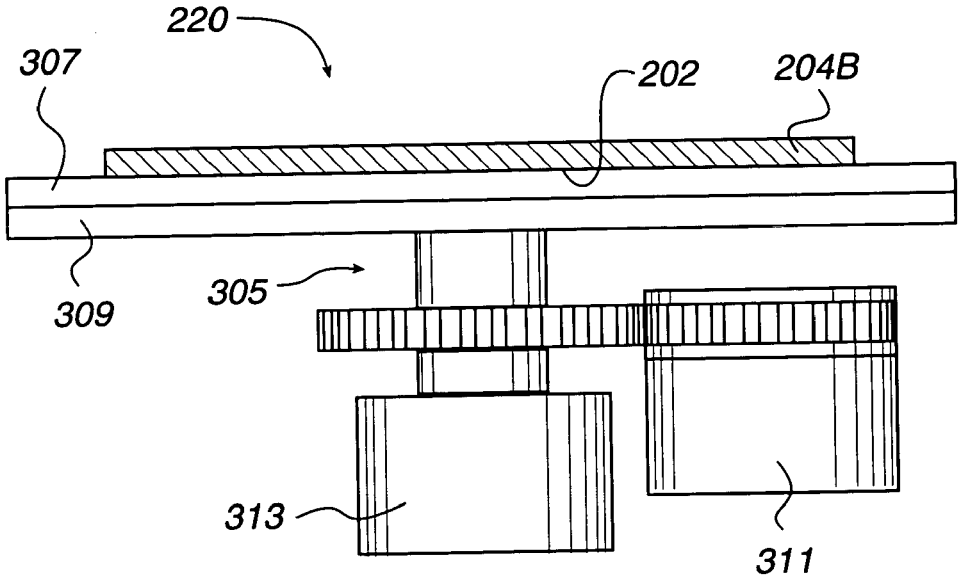
FIG. 6A is a schematic diagram of one embodiment of a conditioner, illustrating devices for controlling the rate at which the conditioner conditions the polishing surface.

As described above, the initial response of the conditioner 214 may be to start conditioning according to the conditioning recipe selected (or established) in conjunction with the establishment of the limits 212. FIG. 6A is a schematic diagram of one embodiment of the conditioner 214, illustrating one group of devices 305 for controlling the rate Rr at which the conditioner conditions the polishing surface 202. Such devices 305 may include a conditioner pad or puck 307 mounted to engage the polishing surface 202 of the exemplary belt 204B. The puck 307 is mounted on a rotary table 309 driven by a motor 311. The puck 307 is urged by a force against the polishing surface 202 by a second motor 313. The polishing recipe may specify a value of that force, and the type of polishing puck 307, and the velocity of rotation of the puck 307, for example. These aspects of the recipe for the conditioning may be changed as part of modifying the conditioning recipe so as to control the rate Rr.

Figure 6B:
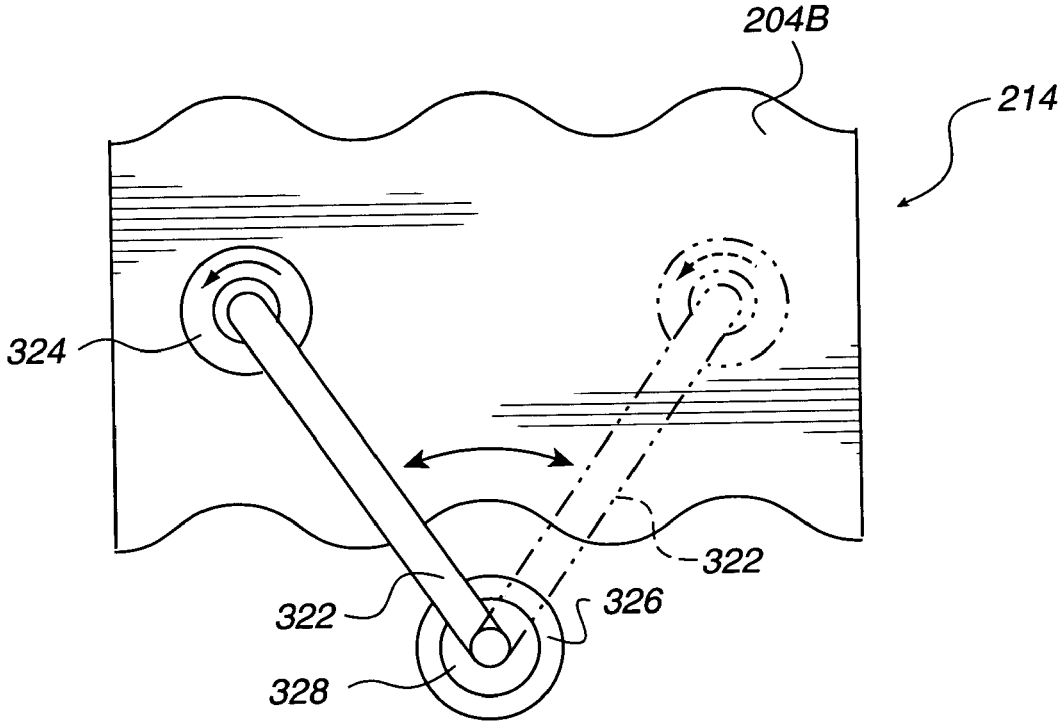
FIG. 6B is a schematic diagram of another embodiment of the conditioner, illustrating other devices for controlling the rate at which the conditioner conditions the polishing surface.

FIG. 6B is a schematic diagram of another embodiment of the conditioner 214, illustrating another group of devices for controlling the rates Rr at which the conditioner 214 conditions the polishing surface 202. The polishing belt 204B is shown as the exemplary polishing pad 204, and an arm 322 is rotated so that a conditioner puck 324 is scanned, or moved, across the polishing surface 202 of the belt 204B. The arm 322 is configured with a drive 326 to rotate the puck 324, and a motor 328 biases the arm so that the puck 324 is urged against the belt 204B with a selected force. Again, the polishing recipe may specify such force, and the type of polishing puck 324, the velocity of rotation of the puck 307, and the frequency of the scanning, for example. Each aspect of the recipe may be changed as part of modifying the initial conditioning recipe so as to control the rate Rr.

Figure 7:
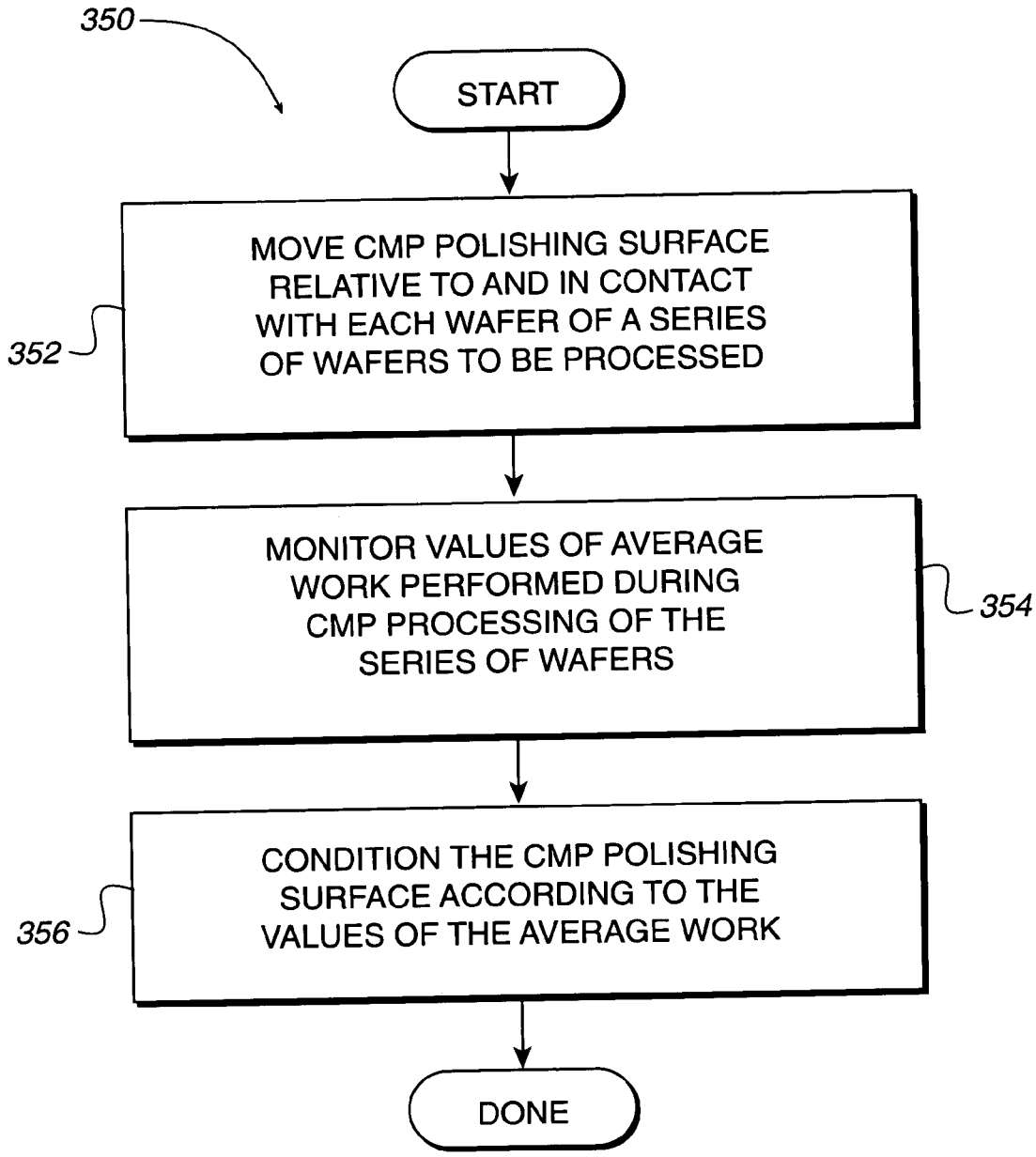
FIGS. 7, 8, and 9 are diagrams illustrating flow charts that show aspects of methods of the present invention for controlling the conditioning of the polishing surface for and during performance of CMP operations on a series of wafers.
Figure 8:
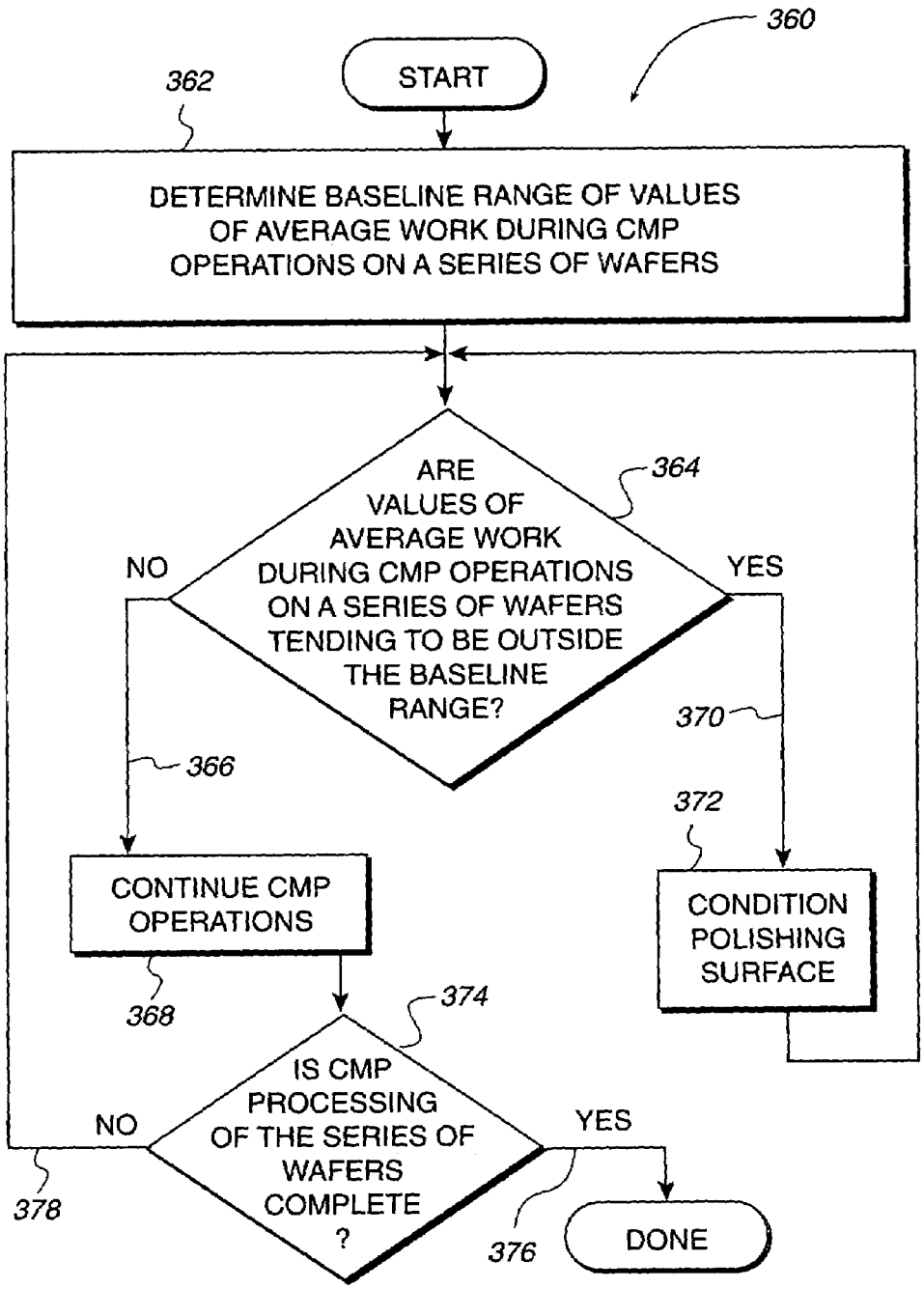
Figure 9:
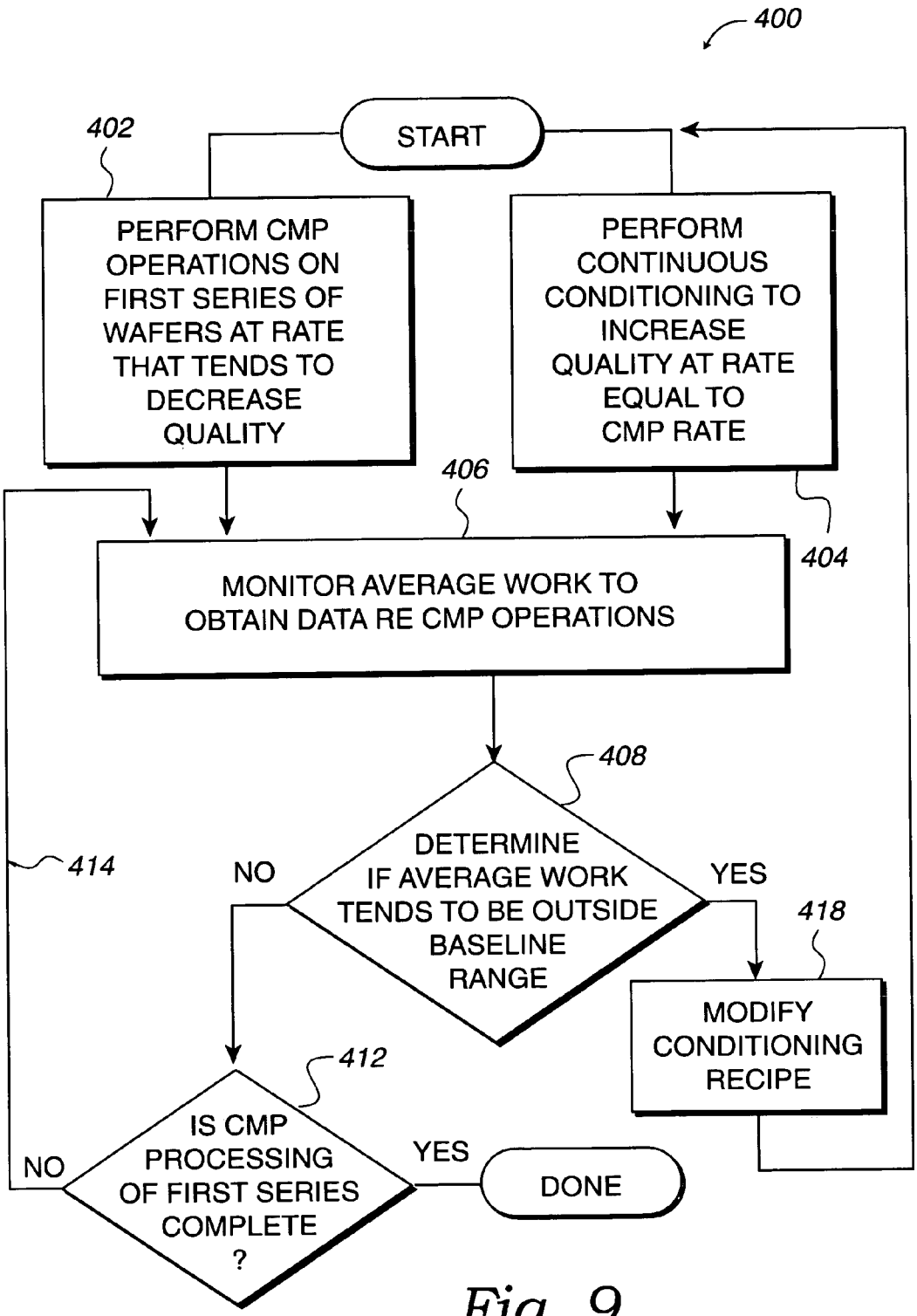

FIGS. 7, 8 and 9 are diagrams illustrating flow charts that show aspects of methods of the present invention for controlling the conditioning of the polishing surface 202 for and during performance of CMP operations. Considering FIG. 7, a flow chart 350 is shown and the method starts by moving to an operation 352 in which the appropriate embodiment of the CMP apparatus 220 is used. Thus, the appropriate embodiment of the embodiments shown in FIGS. 2A, 2B, 2C, 3, 4, 5, 6A and 6B is used. Any such embodiment will have one of the motor configurations described above. In operation 352 the CMP polishing surface 202 is moved relative to and in contact with each of the wafers 200 of the series of wafers 200. The contact is as described above, and performs the CMP process on each of the wafers 200. In this embodiment of the method, the conditioner recipe may call for ex situ conditioning, i.e., to provide results corresponding to the curve 218 in FIG. 1, in which the conditioner 214 is cycled as required to keep the average work W(avg) inside the limits 212. Alternatively, in another embodiment of the method, the conditioner recipe may be designed to call for in situ conditioning to provide results corresponding to the solid-line portion of curve 216 in FIG. 1, in which the conditioner 214 operates continuously and is designed to keep the average work W(avg) inside the limits 212 and relatively constant. The method moves to an operation 354 in which values of the average work W(avg) are monitored, such as by the circuitry 270 as described above. This average work W(avg) is performed during this CMP processing of the series of wafers 200. The circuitry 270 outputs the control signal 274, such as to the conditioner controller 300 as described in regard to FIG. 5. The conditioner controller 300 generates the conditioner control signal 302 which is applied to the conditioner 214. The method moves to an operation 356 in which the conditioner 214 responds to the conditioner control signal 302, and uses the appropriate recipe (i.e., corresponding to one of curves 216 or 218 in FIG. 1 to condition the polishing surface 202 according to the values of the average work W(avg), as represented by the conditioner control signal 302. When the last wafer 200 of the series has been CMP polished, the method is done. Alternatively, the conditioning may be according to the value of the average current I(avg) when the operating velocity of the respective belt 204B, or rotating carrier 226, or rotating polishing pad 204D, or drive belt 266, is controlled so as to be constant.

Reference is made to FIG. 8, which describes a flow chart 360 of another embodiment of the method. The method starts and moves to an operation 362 in which a baseline range of values of the average work W(avg) are determined during performance of CMP operations on n initial series of the wafers 200. The baseline range is determined as described above in paragraph [0049], such that specific ones of the limits 212 may be established for particular specified variables. The limits 212 may be in terms of the baseline range of values of the average current I(avg), or in terms of the values of the average work W(avg) (see FIG. 1). Also as noted, the duration of this CMP processing to establish the baseline range is enough to allow the friction generated between the polishing surface 202 and the materials (not shown) in the surface 206 of the semiconductor substrate 208 of the series of wafers 200 to affect the quality of the polishing characteristic of the polishing surfaces 202 as described above in re FIG. 1. In this embodiment of the method, the ex situ (periodic) conditioning corresponding to curve 218 (FIG. 1) may be used in conjunction with determining the proper limits 212 for the respective embodiment.

The method moves to an operation 364 to start commercial CMP processing according to the variables corresponding to the series of wafers 200 to be processed. The method moves to an operation 364 in which a determination is made as to whether values of average work W(avg) during CMP operations on a series of the wafers 200 tend to be outside of the baseline range. In more detail, whether stated in terms of I(avg) or W(avg), the established limits 212 are used, and the determination of operation 364 may be made during commercial CMP operations performed on the commercial wafers 200. In such commercial CMP operations the same variables are used as were used in establishing the limits 212. In operation 364, as described in reference to FIG. 5, the circuitry 270 measures the current I drawn by the respective motor, and determines the average current I(avg) and average voltage V(avg), and during the time period in which the CMP process is performed on the series of commercial wafers 200, determines the average work W(avg) performed on the series of commercial wafers 200. If the determination of operation 364 is answered no, a branch 366 is taken, and in operation 368 the signal 302 causes the CMP operations to continue based on the current polishing recipe. If the determination of operation 364 is answered yes, a branch 370 is taken, and the signal 302 causes the conditioner 214 to initiate conditioning in an operation 372. Operation 372 may, for example, be performed during removal of one wafer 200 from the CMP apparatus and insertion of a new wafer. The signal 302 starts the conditioning based on the conditioning recipe that was selected when the limits 212, and thus the baseline range, were established in operation 362. The branch 370 continues from operation 372 to operation 364 in which the tendency determination is again made. The method may move from operation 368 to operation 374 in which it is determined whether the CMP operations on all of the wafers of the series of wafers 202 have been completed. If so, a branch 376 is taken and the method is done. If not, the method moves to a branch 378 to operation 364 in which the same tendency determination is made. Thus, after conditioning in operation 372 and via the no branch 378, in operation 364 if the tendency of quality is to be outside the baseline range 212 (answered yes), this yes means that even though the periodic conditioning operation continued according to the current conditioning recipe, if that tendency is not reversed the I(avg) during such commercial CMP operations will no longer be within the limits 212. To avoid that event, the controller 300 may output to the conditioner 214 conditioner control signals 302. In response, if the conditioning operation has paused, the conditioner 214 resumes operations to restore the polishing pad 204 so that the I(avg) will remain within the limits 212. In this manner, the I(avg) will continue to indicate that the quality of the polishing surface 202 is suitable for making wafers 200 that meet the specifications corresponding to those used to establish the limits 212. Oppositely, if notwithstanding the ex situ operation of the conditioner 214 per the selected recipe, for example, the determination of operation 364 is that the tendency of the exemplary decreasing quality will continue so that the average current I(avg) will be outside the limits 212, then in operation 364 the controller 300 will sense this continued tendency before the I(avg) changes enough to be outside the limits 212. In this event, the controller 300 changes the periodic conditioning operation from following the originally selected recipe to a modified recipe. Thus as described above, the controller 300 may cause one or more real-time changes to be made to comply with the modified recipe. If notwithstanding this changed periodic conditioning operation the tendency of the exemplary decreasing quality continues such that the I(avg) will very soon be outside the limits 212, then the controller 300 may generate a signal 380 (FIG. 5) to stop the CMP operation, so that a new polishing pad 204 may be provided, for example.

Reference is made to FIG. 9, which describes a flow chart 400 of another embodiment of the method. Preparation for the method of FIG. 9 is done as described above with respect to operation 362 of FIG. 8, such that there is an appropriate baseline range established. The method starts and moves to an operation 402 with the apparatus 220 set up according to the above-described variables, with the limits 212 established using the wafers having the desired wafer features, and with the conditioning recipe calling for exemplary in situ (continuous) conditioning. In operation 402 CMP operations are performed on a first series of wafers 200 at a first rate R(qd) that tends, for example, to decrease the quality of the polishing surface 202. The first series may include about five, and up to ten or a few tens, of commercial wafers 200, for example. From the start the method also moves to operation 404 in which the in situ conditioning operation is performed simultaneously with the CMP processing. This conditioning operation is performed at a second rate R(ri) that is configured so as to be substantially equal to the first rate, but in an exemplary manner that increases the quality of the polishing surface 202. During each of operations 402 and 404, the method moves to an operation 406 in which the average work W(avg) is monitored during the CMP operations on the first series of the wafers 200. In operation 406, the circuitry 270 measures the current drawn by the respective motor 222, 240, 260, or 270, determines the average current I(avg) and average voltage V(avg), and during the time period in which the CMP process is performed on the series of wafers 200, determines the average work W(avg) performed on the first series of wafers 200. As the monitoring results are obtained, the method moves to an operation 408 in which a determination is made as to whether the values of average work W(avg) tend to be outside of the baseline range.

If operation 408 determines that the values of the average work W(avg) tend not to be outside the baseline range during the CMP operations on the first series of the commercial wafers 200, the method takes a branch to an operation 412. In operation 412 it is determined whether the CMP operations on all of the commercial wafers of the series of commercial wafers 202 have been completed. If so, the method is done. If not, the method takes a branch 414 and moves again to operation 406 in which the monitoring is again performed. The method moves to operation 408, which may determine that the average work W(avg) tends to be outside the baseline range during the CMP operations on the first series of the commercial wafers 200. The method moves to an operation 418 in which the conditioning recipe is modified. The modified recipe is to be used with a next, or second, series of commercial wafers 200. The recipe is modified so that there is a lower likelihood that the average work W(avg) will tend to be outside the baseline range during the CMP operations on the second series of the commercial wafers 200. The method then returns to operations 402 and 404 which are performed with respect to the second series of wafers 200. The method moves to operation 406 and the remaining operations of FIG. 9. The method continues until operation 412 determines that the CMP processing of the second series of wafers 200 is complete. Alternatively, if operation 418 is performed in regard to the second series of wafers and the controller 300 determines that no further modifications are available for the conditioning recipe, the controller 300 causes the CMP process to stop, so that a new polishing pad 204 may replace the current pad 204.

In review, the present invention provides the apparatus 220 and methods for controlling the CMP operations to provide the uniform polishing of the wafers 200. The CMP apparatus 220 with the circuitry 270 enable the average motor current I(avg) drawn by, and related average work W(avg) performed by, the respective motor 222, 240, 250, or 260, during CMP operations on the series of wafers 200 to be reliable indicators of the exemplary roughness aspect of CMP operations, which roughness is other than the structure of one wafer 200 that is CMP processed. The roughness is a polishing characteristic of the polishing surface 202 of the polishing pad 204 that is applied to the series of wafers 200 during the ongoing CMP operations. The circuitry 270 and conditioner controller 300 provide control of the rate R(q) of change of the quality of the polishing surface 202 due to the CMP processing, in relation to the rate Rr at which the quality of the polishing surface is restored by the conditioning. In the in situ conditioning, for example, the rate R(q) of change of the quality due to the CMP processing may thus be controlled to be substantially equal to the rate R(r) of restoration. In the ex situ conditioning, on the other hand, the rate R(q) of change of the quality due to the CMP processing may be substantially less than the controlled rate R(r) of restoration. In the CMP apparatus 220 the drive is provided with the respective motor 222 (or 250), or 240, for the respective one of the polishing surface 202 and carrier 226, and the circuitry 270 is connected to such respective motor of the drive for determining values of average current I(avg) and average work W(avg) used by the drive during CMP of the series of the wafers 200. The circuitry 270 generates control signals 274 indicative of whether the roughness polishing characteristic of the polishing surface 202 is within the acceptable range 212 during the CMP of the series of the wafers.

The motor current I is also measured and averaged over a number of the CMP processed wafers 200, with the polishing surface 202 moved at a constant velocity relative to each of the wafers 200 of the series of wafers that are being polished. In this constant velocity configuration, the control signal 274 may be generated proportional to the average current I(avg), and the average current I(avg) represents the quality of the polishing characteristic of the polishing surface 202.

The drive is further seen to be configured with the respective motor 222 (or 250), or 250, having the respective rotor (e.g., 236) and the 1:1 connection of the rotor to the one of the polishing surface 202 and the carrier 226 so that the signal to noise ratio of the motor current measured by the circuitry is suitable for the average current I(avg) and average work W(avg) to represent the quality of the polishing characteristic of the polishing surface 202.

The polishing surface 202 is seen as being configured with the polishing characteristic having the quality that tends to change from a first value during performance of the CMP process on the series of the wafers 200. The quality is restorable to the first value during the operational life of the polishing surface 202. The detector 270 measures motor current I and determines the amount of work W(avg) performed by the drive during successive periods of time during the performance of the CMP process on the series of the wafers 200. The detector 270 is configured to output the control signal 274 having the signal values indicative of the amount of the work W(avg) performed. Exemplary signals 274 may cause a flag alarm in the event that the average work (Wavg) corresponds to the portion 216D (FIG. 1), for example. The flag alarm may be provided by the signal 380 (FIG. 5) in response to that exemplary signal 274 having a sudden change in value. The conditioner controller 300 is responsive to the control signal 274 for controlling the conditioner 214 so that the polishing characteristic is restored, and thus rendered uniform during the CMP process performed on the series of the wafers 200 during the operational life of the polishing surface 202. The conditioner 214 is thus controlled to offset the tendency of the quality to change from the first value during the performance of the CMP process on the series of the wafers 200 during the operational life of the polishing surface.

The method of the present invention controls the conditioning of the polishing surface 202 during performance of the CMP process on the series of wafers 200 by monitoring values of the average work W(avg) performed during the CMP processing of the series of the wafers 200. Conditioning of the polishing surface 202 may be performed during the CMP processing of the series of wafers 200, and is according to the values of the monitored average work W(avg). The method also includes defining the baseline range 212 of the values of the average work W(avg) performed, and controlling the conditioning operation according to whether the monitored values of the average work W(avg) performed are within the baseline range 212.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. Apparatus for chemical mechanical polishing (CMP), comprising:

a carrier for rotating a wafer to be polished;

a polishing surface movable in relation to and in contact with the wafer;

a drive for one of the carrier and the polishing surface, wherein the drive is configured with a motor having a rotor and a 1:1 connection of the rotor to the one of the carrier and the polishing surface;

circuitry connected to the drive for measuring values of work performed by the drive during CMP of a series of the wafers, the circuitry generating a control signal indicative of whether a polishing characteristic of the polishing surface is within an acceptable range during the CMP of the series of the wafers, wherein the acceptable range is based on the polishing characteristic having a quality that tends to change at a first rate from a first value during performance of the CMP on the series of the wafers, the acceptable range being further based on the quality being restorable to the first value at a second rate; and a conditioner responsive to the control signal for maintaining the polishing characteristic of the polishing surface within the acceptable range by conditioning the polishing surface at the second rate, the second rate being substantially the same as the first rate.

2. Apparatus as recited in claim 1, wherein:

the polishing surface is elongated, the drive is configured with a motor having a rotor in direct engagement with the elongated polishing surface, the motor performs work during the polishing, and average values of the work performed are indicative of a roughness characteristic of the elongated polishing surface.

3. Apparatus as recited in claim 1, wherein:

the polishing surface rotates, the drive is configured with a motor having a rotor configured to directly rotate the polishing surface, the motor performs work during the polishing, and average values of the work performed are indicative of a roughness characteristic of the rotating polishing surface.

4. Apparatus as recited in claim 1, wherein:

the drive is configured with a rotor in direct engagement with the carrier to rotate the wafer, the motor performs work during the polishing, and average values of the work performed are indicative of a roughness characteristic of the polishing surface.

5. Apparatus for maintaining uniformity of a polishing characteristic of a polishing surface for a chemical mechanical polishing (CMP) process, the apparatus comprising:

a carrier for rotating a wafer during the CMP process;

a polishing surface movable in relation to and in contact with the wafer, the polishing surface being configured with the polishing characteristic, the polishing characteristic having a quality that tends to change from first values in an acceptable quality range to second values outside of the range during performance of the CMP process on a series of the wafers, the quality being restorable to the acceptable quality range during an operational life of the polishing surface;

a drive for one of the carrier and the movable polishing surface;

a detector for determining an amount of work performed by the drive during successive periods of time during the performance of the CMP process on the series of the wafers, the detector being configured to output a control signal having signal values indicative of the amount of the work performed;

a conditioner for the polishing surface, the conditioner being configured to restore the quality of the polishing characteristic of the polishing surface to the first values during the operational life of the polishing surface; and a controller responsive to the control signal for controlling operation of the conditioner so that the controller operates simultaneously with the performance of the CMP process on the series of the wafers to offset the tendency of the quality to change from the first values so that the polishing characteristic is maintained within the acceptable quality range during the performance of the CMP process performed on the series of the wafers during the operational life of the polishing surface.

6. Apparatus as recited in claim 5, wherein the drive is configured to cause the output signal to have a high signal to noise ratio so that the output signal further indicates the quality of the polishing characteristic of the polishing surface.

7. Apparatus as recited in claim 5, wherein the drive is configured so that the corresponding one of the carrier and the polishing surface has a substantially constant operating velocity so that the control signal is proportional to average current drawn by the drive, and the average current represents the quality of the polishing characteristic of the polishing surface.

8. Apparatus as recited in claim 5, wherein:

the drive is configured so that the corresponding one of the rotating carrier and the movable polishing surface has a substantially constant operating velocity, the drive is configured with a motor, and the detector determines the amount of work by measuring the current drawn by the motor.

9. Apparatus for maintaining uniformity of a polishing characteristic of a polishing surface for a chemical mechanical polishing (CMP) process, the apparatus comprising:

a carrier for rotating a wafer during the CMP process;

a polishing surface movable in relation to and in contact with the wafer, the polishing surface being configured with the polishing characteristic, the polishing characteristic having a quality that tends to change from a first value during performance of the CMP process on a series of the wafers, the quality being restorable to the first value during an operational life of the polishing surface;

a drive for one of the carrier and the movable polishing surface;

a detector for determining an amount of work performed by the drive during successive periods of time during the performance of the CMP process on the series of the wafers, the detector being configured to output a control signal having signal values indicative of the amount of the work performed;

a conditioner for the polishing surface, the conditioner being configured to restore the quality of the polishing characteristic of the polishing surface to the first value during the operational life of the polishing surface, the conditioner being further configured to restore the quality at a first rate using a first set of operating parameters for the conditioner; and a controller responsive to the control signal for controlling the conditioner so that the polishing characteristic is uniform during the performance of the CMP process performed on the series of the wafers during the operational life of the polishing surface, the conditioner control being to offset the tendency of the quality to change from the first value during the performance of the CMP process on the series of the wafers during the operational life of the polishing surface, the controller being configured to use the control signal to determine whether a second rate at which the quality changes from the first value exceeds the first rate of the restoration.

10. Apparatus as recited in claim 9, wherein the controller is further configured so that if the second rate exceeds the first rate, the controller causes a change in the conditioner operating parameters to increase the first rate to substantially equal the second rate.

11. Apparatus as recited in claim 5, wherein the controller is configured to respond to the control signal to determine whether, after performance of the CMP process on about one or more tens of the wafers of the series of wafers, the operational life of the polishing surface has ended.

12. Apparatus as recited in claim 6, wherein the configuration of the drive comprises the drive configured with a motor having a rotor and a 1:1 connection of the rotor to the one of the carrier and the polishing surface.

13. Apparatus as recited in claim 5, wherein the controller is configured to generate a flag alarm in response to a sudden change of the signal value of the control signal.

14. A method of controlling conditioning of a chemical mechanical polishing (CMP) polishing surface during performance of a CMP process on wafers, the method comprising the operations of:

defining a series of the wafers, the series consisting of a given number of wafers, within the series there being groups of the wafers, each group consisting of fewer than the given number of wafers, a first group being defined to be CMP processed before a second group;

moving the CMP polishing surface relative to and in contact with each wafer of the series of wafers during CMP processing of each wafer, the moving being by operating a motor that performs work during the CMP processing;

monitoring values of average work performed during the CMP processing of each group of the wafers of the series of the wafers; and conditioning the CMP polishing surface simultaneously with the CMP processing of the second group of the series of wafers and according to the value of the monitored average work monitored during the CMP polishing of the first group of wafers.

15. A method as recited in claim 14, further comprising the operations of:

defining a baseline range of the values of the average work, and controlling the conditioning operation according to whether the monitored values of the average work performed on successive groups of the wafers have a tendency to be within or outside of the baseline range, the controlling operation sensing the tendency of a value of a first of the groups to be outside the baseline range before the respective monitored value of the first group is outside the baseline range so that the conditioning operation is effective simultaneously with the CMP polishing of one or more groups of the wafers after the first group to maintain the respective average work within the baseline range during a life of the CMP polishing surface.

16. A method of controlling conditioning of a chemical mechanical polishing (CMP) polishing surface during performance of a CMP process on a series of wafers, the method comprising the operations of:

moving the CMP polishing surface relative to and in contact with each wafer of the series of wafers during CMP processing of each wafer, the moving being by operating a motor that performs work during the CMP processing;

monitoring values of average work performed during the CMP processing of the series of the wafers;

conditioning the CMP polishing surface during the CMP processing of the series of wafers and according to the values of the monitored average work; and configuring the CMP polishing surface with a polishing characteristic having a quality that tends to change from a first value during performance of the CMP process on a series of the wafers, the quality being restorable by an other change to the first value during an operational life of the polishing surface;

wherein the conditioning operation is performed according to a conditioning recipe selected to equalize a rate of the change from the first value and a rate of the restoration by the other change.

17. A method as recited in claim 15, wherein if during the CMP processing of the one or more groups of wafers the monitoring operation determines that the average work performed on the one or more groups of wafers is tending to be outside of the baseline range, the controlling operation comprises:

changing a recipe for conditioning the polishing surface, and simultaneously with CMP processing of a further group of the wafers conditioning the polishing surface according to the changed recipe, the further group being after the one or more groups.

18. A method as recited in claim 17, the method further comprising the operation of:

continuing the monitoring operation in respect to the further and successive groups of the series of wafers to determine whether the average work performed on the wafers of the further and successive groups of the series of wafers using the changed recipe is tending to be within or outside of the baseline range.

19. A method of controlling conditioning of a chemical mechanical polishing (CMP) polishing surface during performance of a CMP process on a series of wafers, the method comprising the operations of:

moving the CMP polishing surface relative to and in contact with each wafer of the series of wafers during CMP processing of each wafer, the moving being by operating a motor that performs work during the CMP processing;

defining a baseline range of the values of the average work, monitoring values of average work performed during the CMP processing of the series of the wafers;

conditioning the CMP polishing surface during the CMP processing of the series of wafers and according to the values of the monitored average work;

controlling the conditioning operation according to whether the monitored values of the average work performed are within the baseline range, wherein if the monitoring operation determines that the average work performed on a first series of wafers is tending to be outside of the baseline range, the controlling operation comprises changing a recipe for conditioning the polishing surface for use with a second series of wafers;

continuing the monitoring operation in respect to the second series of wafers to determine whether the average work performed on the wafers of the second series of wafers is tending to be in or outside of the baseline range;

determining that an end of operating life has occurred in regard to a current polishing surface if the average work performed on the second series of wafers tends to be outside of the baseline range, and replacing the current polishing surface with a next polishing surface for the CMP processing, the next polishing surface being configured with the polishing characteristic, wherein upon resuming CMP processing with the next polishing surface a rate of change of the quality from the first value due to the CMP process will be substantially equal to a rate of change of the quality due to the conditioning operation.

20. A method as recited in claim 14, wherein:

the monitoring of the values of average work performed during the CMP processing of each group of the wafers of the series of the wafers senses a first rate of change of the values indicating a tendency of a quality of the polishing surface to become unacceptable; and the conditioning of the CMP polishing surface simultaneously with the CMP processing of the second group of the series of wafers is according to the sensing of the first rate of change of the values, and the simultaneous conditioning occurs periodically during the CMP processing of the second group of the series of wafers and at a rate exceeding and opposite to the first rate.

21. A method as recited in claim 14, wherein:

the monitoring of the values of average work performed during the CMP processing of each group of the wafers of the series of the wafers senses a first rate of change of the values indicating a tendency of a quality of the polishing surface to become unacceptable; and the conditioning of the CMP polishing surface simultaneously with the CMP processing of the second group of the series of wafers is according to the sensing of the first rate of change of the values, and the simultaneous conditioning occurs continuously during the CMP processing of the second group of the series of wafers and at a rate equal and opposite to the first rate.

* * * * *